US008845499B1

(12) United States Patent
Boatwright

(10) Patent No.: US 8,845,499 B1
(45) Date of Patent: Sep. 30, 2014

(54) PERSONAL FORCE RESISTANCE CABLE EXERCISE DEVICE, FORCE RESISTANCE ASSEMBLY, AND METHOD OF EXERCISING

(76) Inventor: Donald Jeffrey Boatwright, Charlotte, NC (US)

( * ) Notice: Subject to any disclaimer, the term of this patent is extended or adjusted under 35 U.S.C. 154(b) by 236 days.

(21) Appl. No.: 13/315,847

(22) Filed: Dec. 9, 2011

(51) Int. Cl.
*A63B 21/015* (2006.01)

(52) U.S. Cl.
USPC ..... 482/116

(58) Field of Classification Search
CPC ..... A63B 21/015; A63B 21/153
USPC ..... 482/97–103, 114–116, 92–94, 482/120–121; 242/397, 615.3
See application file for complete search history.

(56) References Cited

U.S. PATENT DOCUMENTS

| | | | | |
|---|---|---|---|---|
| 141,967 | A * | 8/1873 | Van Houten | 185/32 |
| 3,785,644 | A * | 1/1974 | Bradley et al. | 482/127 |
| 5,139,469 | A | 8/1992 | Hennessey et al. | |
| 5,400,875 | A | 3/1995 | Anthony et al. | |
| 5,433,299 | A | 7/1995 | Sundstrom et al. | |
| 5,586,624 | A | 12/1996 | Ko et al. | |
| 5,992,618 | A | 11/1999 | Joh | |
| 6,030,321 | A | 2/2000 | Fuentes | |
| 6,315,701 | B1 * | 11/2001 | Shifferaw | 482/114 |
| 6,569,065 | B1 | 5/2003 | Menold et al. | |
| 6,659,922 | B1 | 12/2003 | Yu | |
| 6,726,607 | B1 | 4/2004 | Ihli | |
| 6,749,050 | B2 | 6/2004 | Ouchi | |
| 6,770,014 | B2 | 8/2004 | Amore | |
| 7,087,001 | B1 | 8/2006 | Ihli | |
| 7,506,697 | B2 | 3/2009 | Pflieger | |
| 7,909,745 | B2 * | 3/2011 | Mills et al. | 482/130 |
| 2003/0087735 | A1 * | 5/2003 | Chen | 482/116 |
| 2004/0102292 | A1 * | 5/2004 | Pyles et al. | 482/54 |
| 2004/0204293 | A1 | 10/2004 | Andreasen | |
| 2007/0284209 | A1 | 12/2007 | Chen | |
| 2010/0144496 | A1 | 6/2010 | Schmidt | |

* cited by examiner

*Primary Examiner* — Oren Ginsberg
*Assistant Examiner* — Megan Anderson
(74) *Attorney, Agent, or Firm* — Schwartz Law Firm, P.C.

(57) ABSTRACT

A personal force-resistance cable exercise device includes a force resistance assembly, elongated flexible cable, and a movable exercise implement. The force resistance assembly comprises a mounting frame, a rotatable assembly shaft carried by the mounting frame, a disk rotor fixedly attached to the assembly shaft, an adjustable friction controller adapted for frictionally engaging the disk rotor, and a one-way cable spool. The one-way cable spool is locked to the assembly shaft upon rotation of the cable spool in a working force-resistance direction, and is freely movable relative to the assembly shaft upon rotation of cable spool in an opposite cable-wind-up direction. The flexible cable is attached to the force resistance assembly, and adapted for winding on and unwinding from the cable spool. The exercise implement is attached to the flexible cable, and adapted for being employed by a user performing an exercise.

17 Claims, 10 Drawing Sheets

PERSONAL FORCE RESISTANCE CABLE EXERCISE DEVICE, FORCE RESISTANCE ASSEMBLY, AND METHOD OF EXERCISING

TECHNICAL FIELD AND BACKGROUND OF THE INVENTION

This invention relates broadly and generally to personal exercise devices, and in one embodiment, more particularly to a one-way force-resistance cable exercise device, force resistance assembly, and method of exercising. In exemplary embodiments discussed herein, the present exercise device does not require electrical power, is generally light weight, compact in size, and portable, can be conveniently stored under a bed or in a closet, and can be packaged in a small bag and readily transported anywhere by anyone.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a personal force-resistance cable exercise device. The exercise device includes a force resistance assembly, elongated flexible cable, and a movable exercise implement. The force resistance assembly comprises a mounting frame, a rotatable assembly shaft carried by the mounting frame, a disk rotor fixedly attached to the assembly shaft, an adjustable friction controller adapted for frictionally engaging the disk rotor, and a one-way cable spool. The one-way cable spool is locked to the assembly shaft upon rotation of the cable spool in a working force-resistance direction, and is freely movable relative to the assembly shaft upon rotation of cable spool in an opposite cable-wind-up direction. The flexible cable is attached to the force resistance assembly, and adapted for winding on and unwinding from the cable spool. The exercise implement is attached (either directly or indirectly) to the flexible cable, and is adapted for being employed by a user performing an exercise.

The term "one-way cable spool" refers broadly herein to any rotatable unit which is allowed to substantially freewheel in one direction on a shaft, but when a torque is applied in the opposite direction, the unit locks, binds, or wedges onto the shaft because of changes in bearing alignment and friction. In the present exemplary embodiment, the cable spool operates in "one-way" by locking onto the assembly shaft when rotated in the working or force-resistance direction, but slips over the assembly shaft when counter-rotated in the cable-wind-up direction.

According to another exemplary embodiment, a cable rewind spring is operatively attached to the one-way cable spool, and is adapted for normally urging rotation of the cable spool in the cable-wind-up direction. Alternatively, the cable spool may be rotated in the cable-wind-up direction via DC motor, or other electro-mechanical or mechanical means.

According to another exemplary embodiment, the one-way cable spool incorporates a one-way needle bearing adapted for operatively engaging the assembly shaft upon rotation of the cable spool in the working force-resistance direction. The needle bearing may be integrally formed with the cable spool, or separately formed and permanently attached (e.g., by press-fit, welding or other means). In alternative arrangements, a sprag clutch or other means may be employed to effect one-way operation of the cable spool.

According to another exemplary embodiment, the one-way cable spool comprises a plurality of circumferential grooves adapted for controlling overlap of the cable when winding on the spool.

According to another exemplary embodiment, first and second end bearings are attached to the mounting frame and located at respective opposite ends of the assembly shaft.

According to another exemplary embodiment, the friction controller incorporates a hand-turnable adjustment knob.

According to another exemplary embodiment, the friction controller further comprises first and second cooperating friction pads adapted for operatively engaging respective opposite surfaces of the disk rotor. The friction pads may be hydraulically actuated (as with a conventional hydraulic brake assembly) or mechanically non-hydraulically actuated via attached wires.

According to another exemplary embodiment, a pivoted foot stop is designed for operatively engaging the cable spool to limit rotation of the cable spool in the cable-wind-up direction.

According to another exemplary embodiment, a standing platform is located adjacent the force resistance assembly.

According to another exemplary embodiment, the exercise implement comprises an elongated hollow (e.g., metal) bar having a cable-entry end and an opposing cable-exit end, and bar pulleys located at respective cable-entry and cable-exit ends. The flexible cable extends through the exercise bar and outwardly from its cable-exit end towards the standing platform.

According to another exemplary embodiment, means are provided for releasably attaching the free end of the flexible cable to the standing platform.

According to another exemplary embodiment, the means for releasably attaching the flexible cable comprises a cam cleat fixed to the standing platform.

According to another exemplary embodiment, an electronic scale is adapted for measuring a force exerted by the user when performing the exercise.

According to another exemplary embodiment, a display monitor is connected to the scale for displaying the measured force exerted by the user.

In another exemplary embodiment, the present disclosure comprises a cable exercise device including a force resistance assembly, an elongated flexible cable, and a movable exercise implement. In this embodiment, the force resistance assembly comprises a rotatable assembly shaft and a one-way cable spool carried by the assembly shaft. The force resistance assembly further comprises means for locking the one-way cable spool to the assembly shaft upon rotation of the cable spool in a working force-resistance direction, and for enabling free movement of cable spool relative to the assembly shaft upon rotation of cable spool in an opposite cable-wind-up direction. The flexible cable is attached to the force resistance assembly, and is adapted for winding on and unwinding from the cable spool. The movable exercise implement is attached (either directly or indirectly) to the flexible cable, and is adapted for being employed by a user performing an exercise. The exercise implement may comprise any movable structure designed for being pushed, pulled, pressed, curled, raised, lifted, or otherwise moved by a user against the force of the resistance assembly in one or more exercise repetitions utilizing the exemplary exercise device.

In yet another exemplary embodiment, the present disclosure comprises a method for exercising. The method includes exerting a force (directly or indirectly) against an exercise implement attached (directly or indirectly) to an elongated flexible cable. The flexible cable is attached to a force resistance assembly comprising a mounting frame, a rotatable assembly shaft carried by the mounting frame, a disk rotor fixedly attached to the assembly shaft, an adjustable friction controller adapted for frictionally engaging the disk rotor, and a one-way cable spool. The one-way cable spool is locked to the assembly shaft upon rotation of the cable spool in a working force-resistance direction, and is freely movable relative to the assembly shaft upon rotation of cable spool in an opposite cable-wind-up direction.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
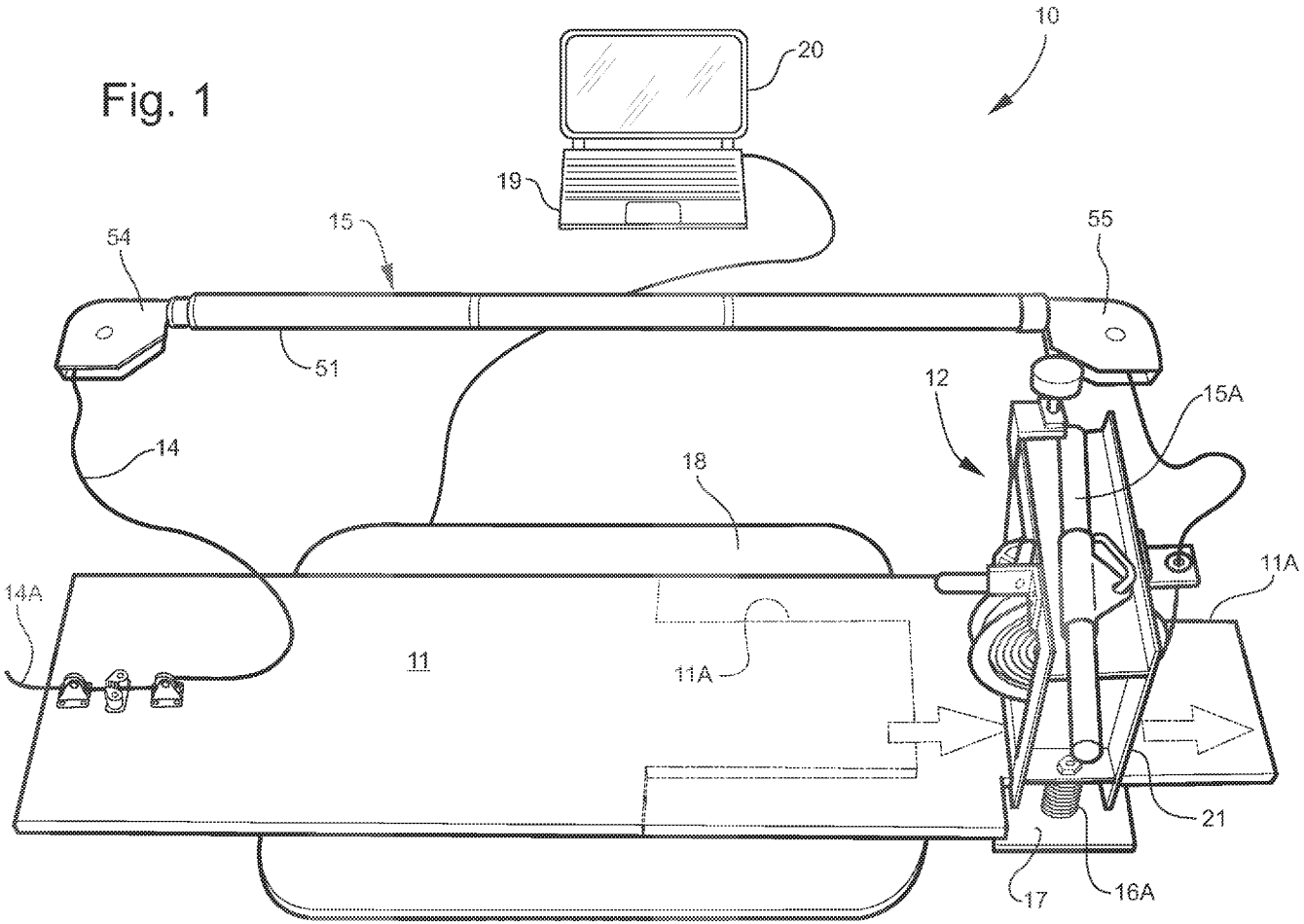
FIG. 1 is a perspective view of a personal force-resistance exercise device according to one exemplary embodiment of the present disclosure.

Referring now specifically to the drawings, a personal force-resistance cable exercise device according to one exemplary embodiment of the present disclosure is illustrated in FIG. 1, and shown generally at broad reference numeral 10. The exemplary exercise device 10 comprises a rigid standing platform 11, a compact force resistance assembly 12 adjacent the platform 11, a flexible steel cable 14 attached to the force resistance assembly 12, and an elongated double-pulley exercise bar 15 attached to the cable 14. The force resistance assembly 12 is carried by spaced-apart heavy gauge coil springs 16A, 16B (FIG. 5), and is bolted to a relatively small flat planar base 17. The standing platform 11 is unattached to the force resistance assembly 12, and may have a notched end 11A designed to fit between the coil springs 16A, 16B and over the assembly base 17. In one embodiment, the exemplary platform 11 sits atop an electronic scale 18 communicating (via wired or wireless connection) with computer 19 for measuring real-time force exerted by the user when performing an exercise. The measured force may be displayed to the user on monitor 20.

Figure 2:
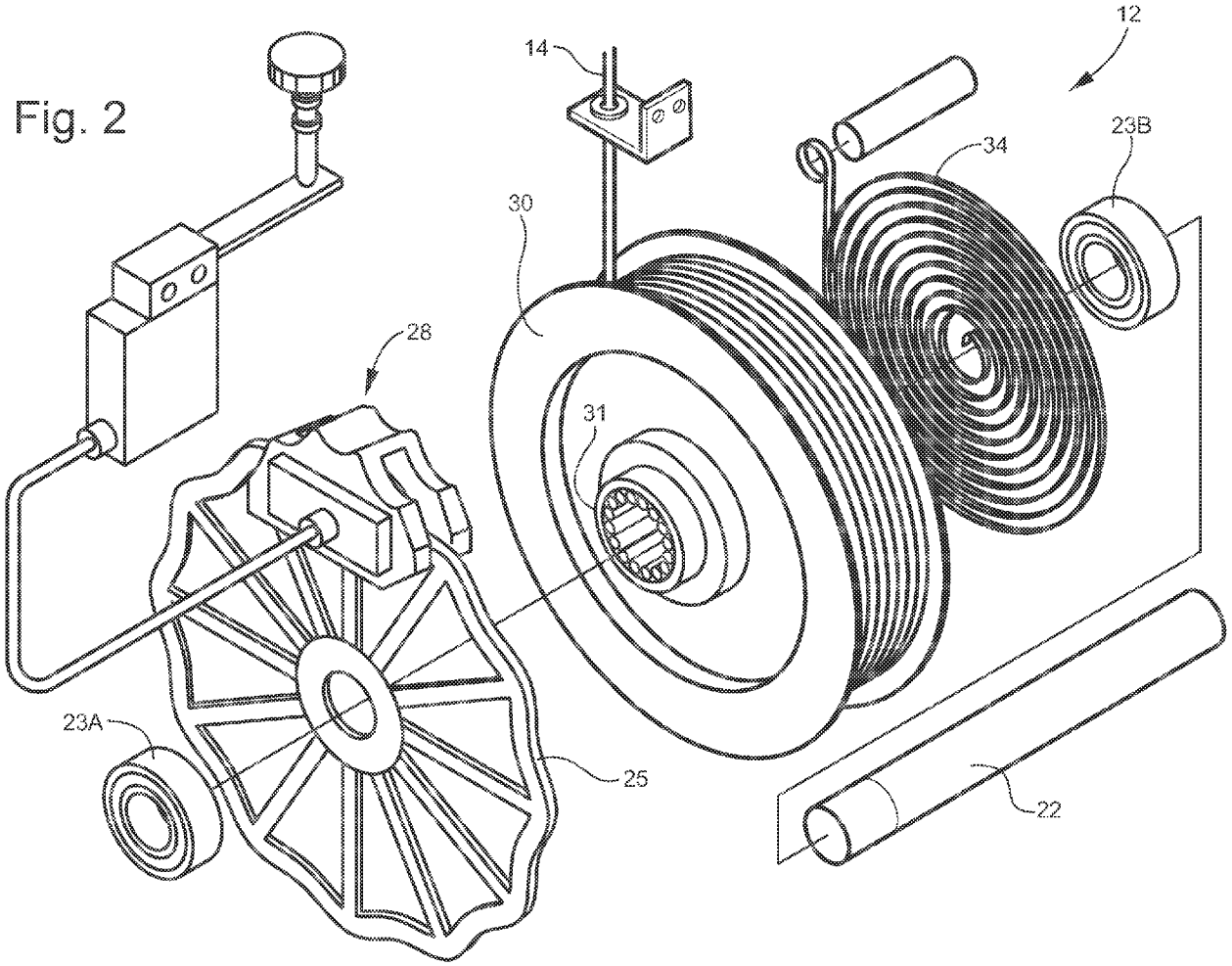
FIG. 2 is an exploded view illustrating various parts of the force resistance assembly.
Figure 3:
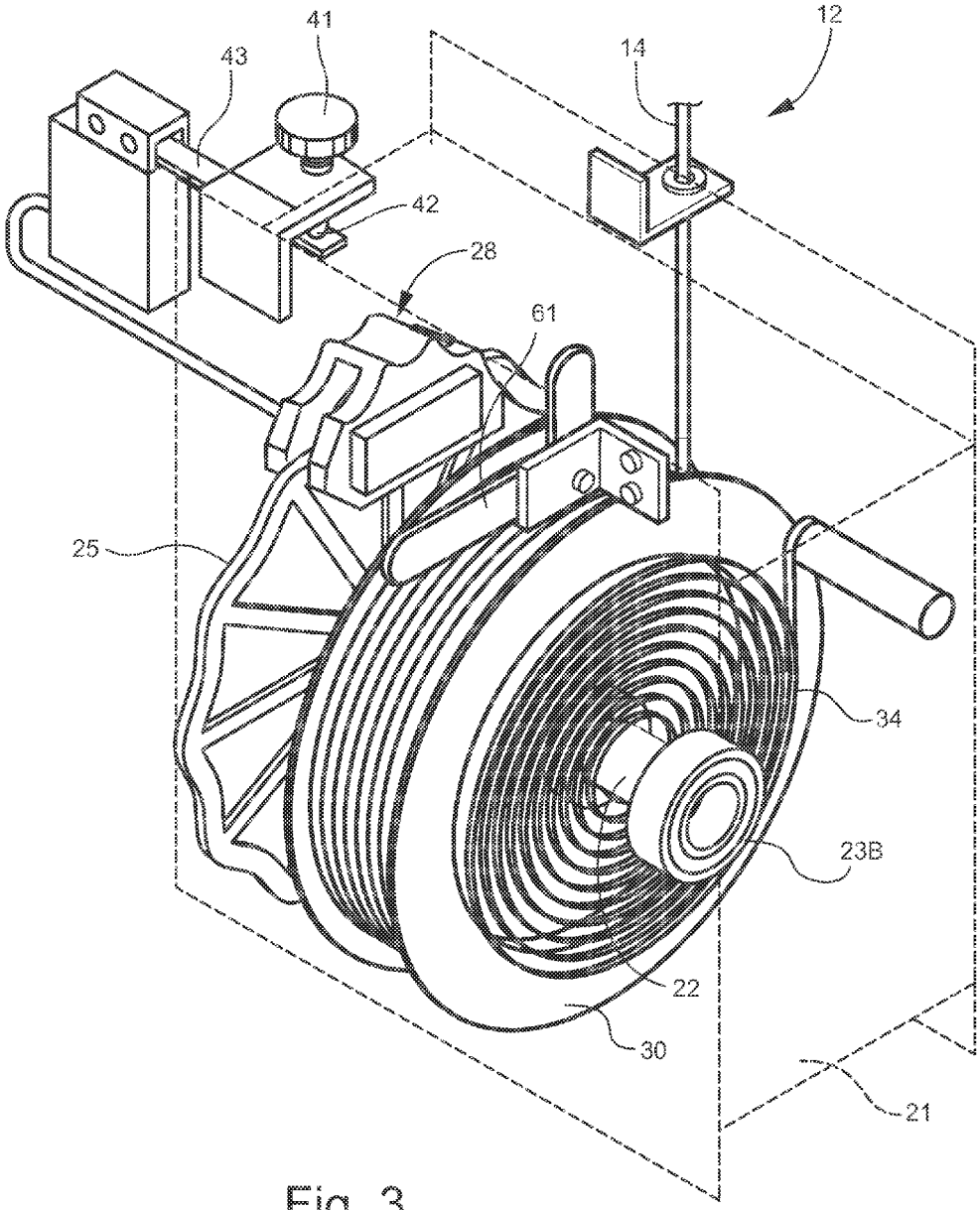
FIG. 3 is an assembled perspective view of the exemplary force resistance assembly.
Figure 4:
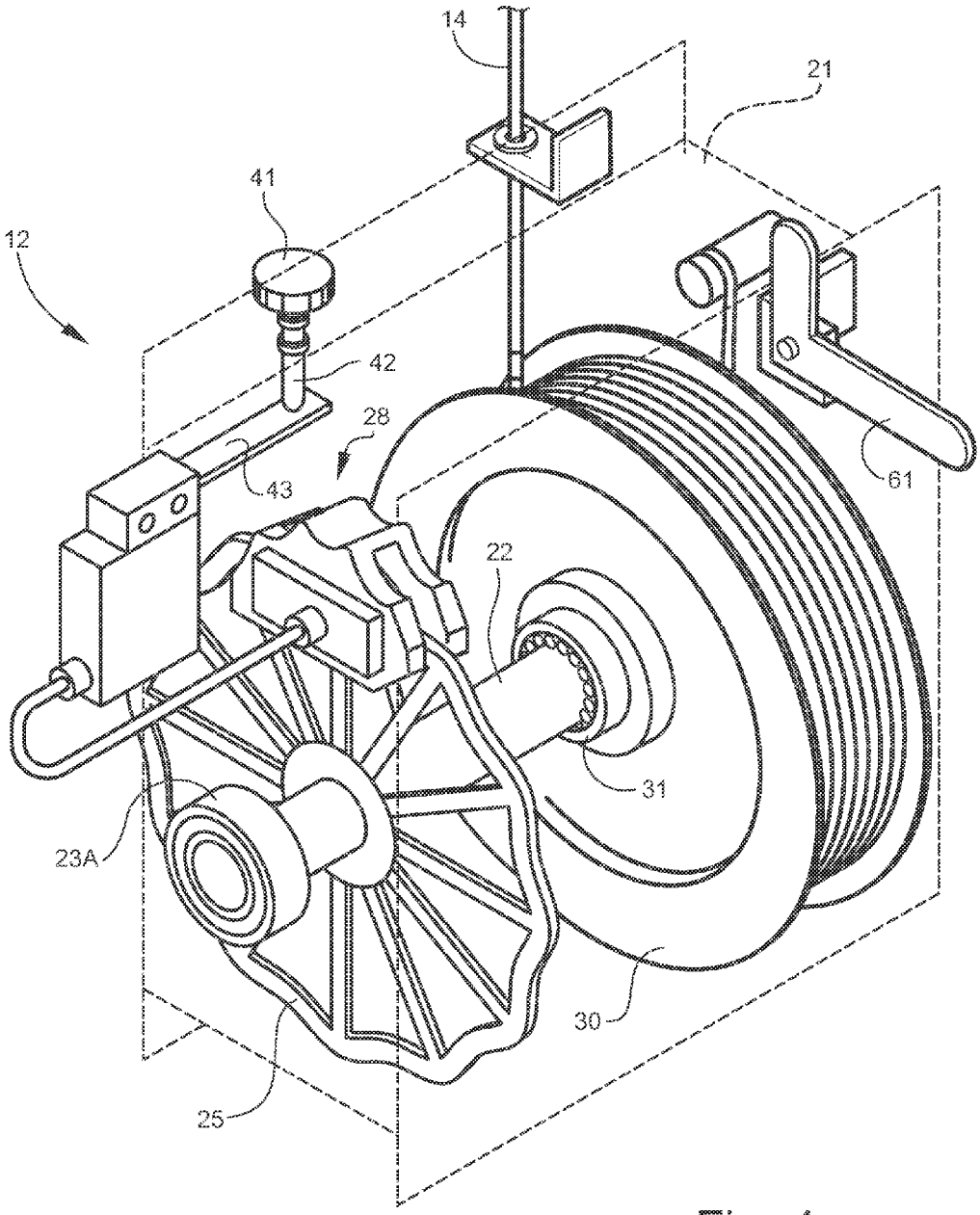
FIG. 4 is a further assembled perspective view of the exemplary force resistance assembly.

As best shown in FIGS. 2, 3, and 4, the exemplary force resistance assembly 12 comprises a steel mounting frame 21 (FIG. 1), a rotatable assembly shaft 22 supported by end bearings 23A, 23B within the frame 21, a disk rotor 25 fixedly attached (e.g., by welding) to the assembly shaft 22, an adjustable hydraulic friction controller 28 designed to frictionally engage the disk rotor 25, and a one-way cable spool 30. The exemplary assembly shaft 22 may be fabricated of a hardened steel or other metal, or may comprise a less expensive metal with a press-fit hardened outer steel sleeve. The one-way cable spool 30 comprises an integrally (or separately) formed one-way needle bearing 31 which locks to the hardened assembly shaft 22 upon rotation of the cable spool 30 in a working force-resistance direction, and which releases from the assembly shaft 22 upon counter-rotation of the cable spool 30 in an opposite cable-wind-up direction. The flexible cable 14 is attached to the force resistance assembly 12 (e.g., at cable spool 30), and is adapted for winding on and unwinding from the cable spool 30 during use of the exercise device 10, as discussed further below. The exemplary cable spool 30 defines circumferential surface grooves 33 (FIG. 5) which serve to limit (or substantially prevent) overlap of the cable 14 when winding on the spool 30. A spiral torsion spring 34 or other biasing means is attached at one end to the mounting frame 21 and at its other end to the cable spool 30, and functions to normally urge counter-rotation of the cable spool 30 in the cable-wind-up direction.

Figure 5:
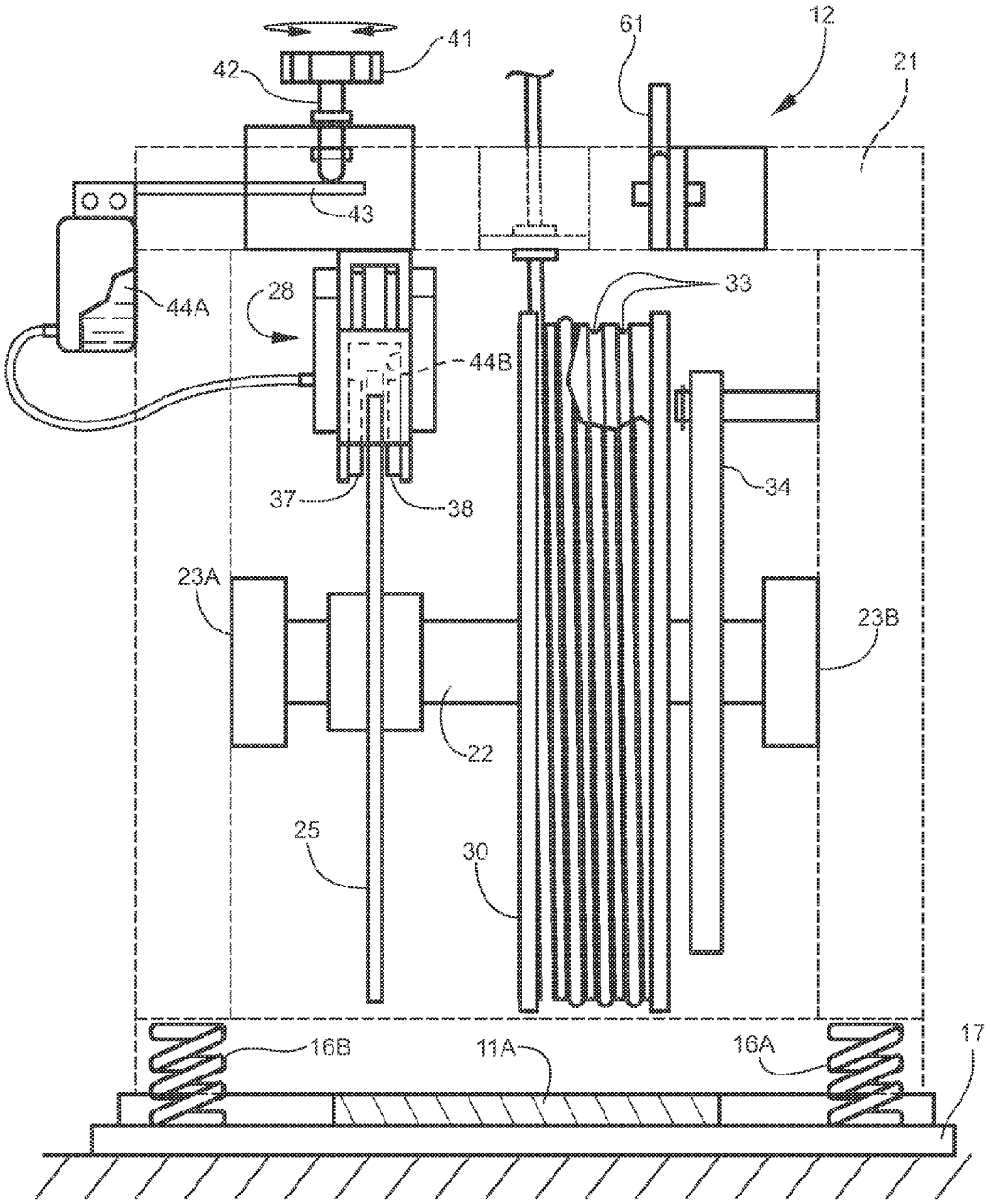
FIG. 5 is a side view of the assembled force resistance assembly.
Figure 5A:
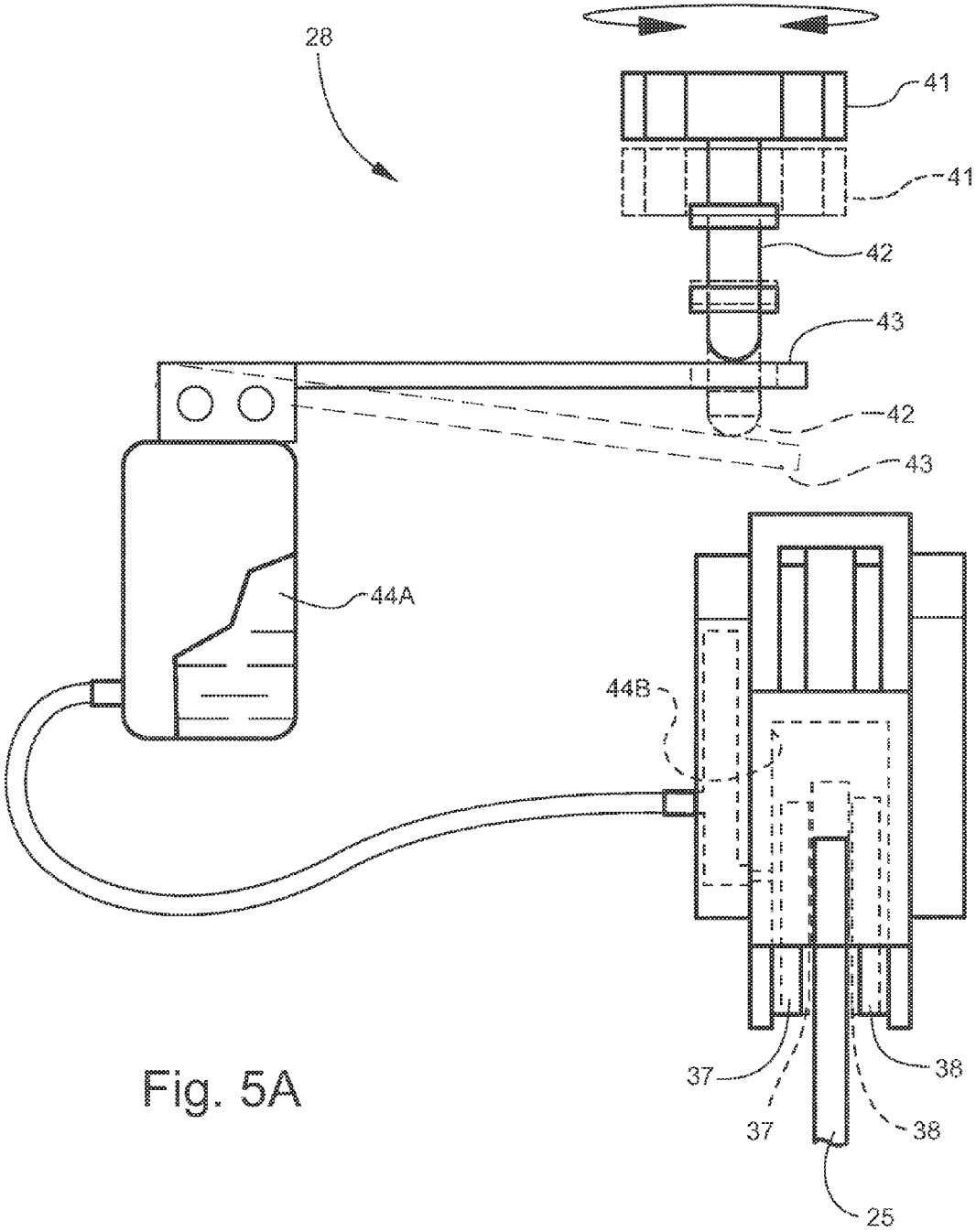
FIG. 5A is a view illustrating various parts of the adjustable hydraulic friction controller.
Figure 6:
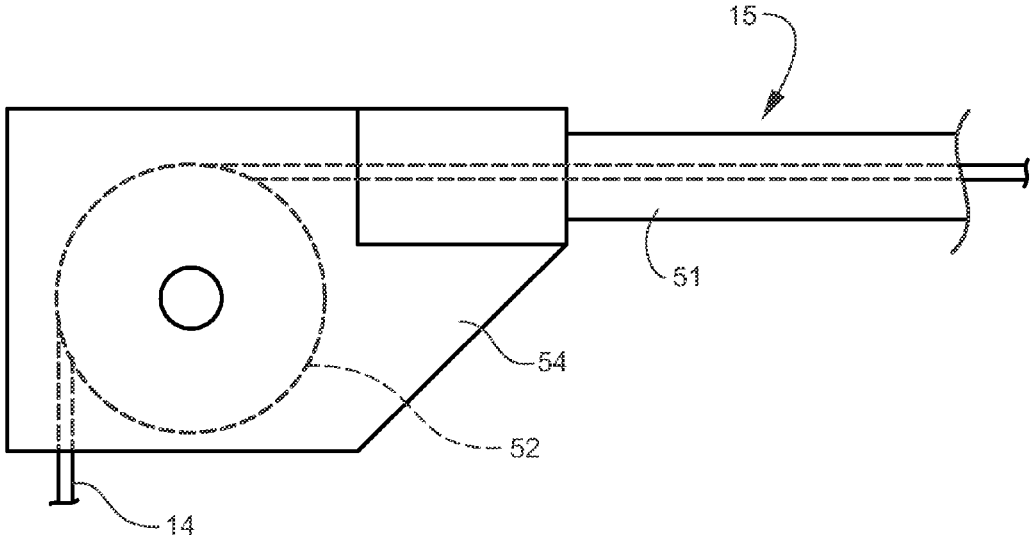
FIG. 6 is a fragmentary view of the elongated exercise bar showing the bracket and pulley assembly at one end.

Referring to FIGS. 5 and 5A, the adjustable friction controller 28 comprises cooperating hydraulic friction pads 37, 38 fabricated of a high-durometer rubber or other such material, and designed to frictionally engage opposite sides of the metal disk rotor 25 upon rotation of the cable spool 30 and assembly shaft 22. A hand-turnable adjustment knob 41, threaded knob shaft 42 and valve lever 43 cooperate to control the flow of hydraulic fluid from reservoir 44A into chamber 44B causing friction pads 37, 38 to increase or decrease frictional contact with the disk rotor 25. The adjustment knob 41 temporarily sets the desired force resistance, and enables substantially infinite precision adjustment within a wide range—i.e., from substantially zero resistance (free rotation) to substantial immovability. The adjustment knob may also comprise resistance-setting indicia not shown.

Figure 7:
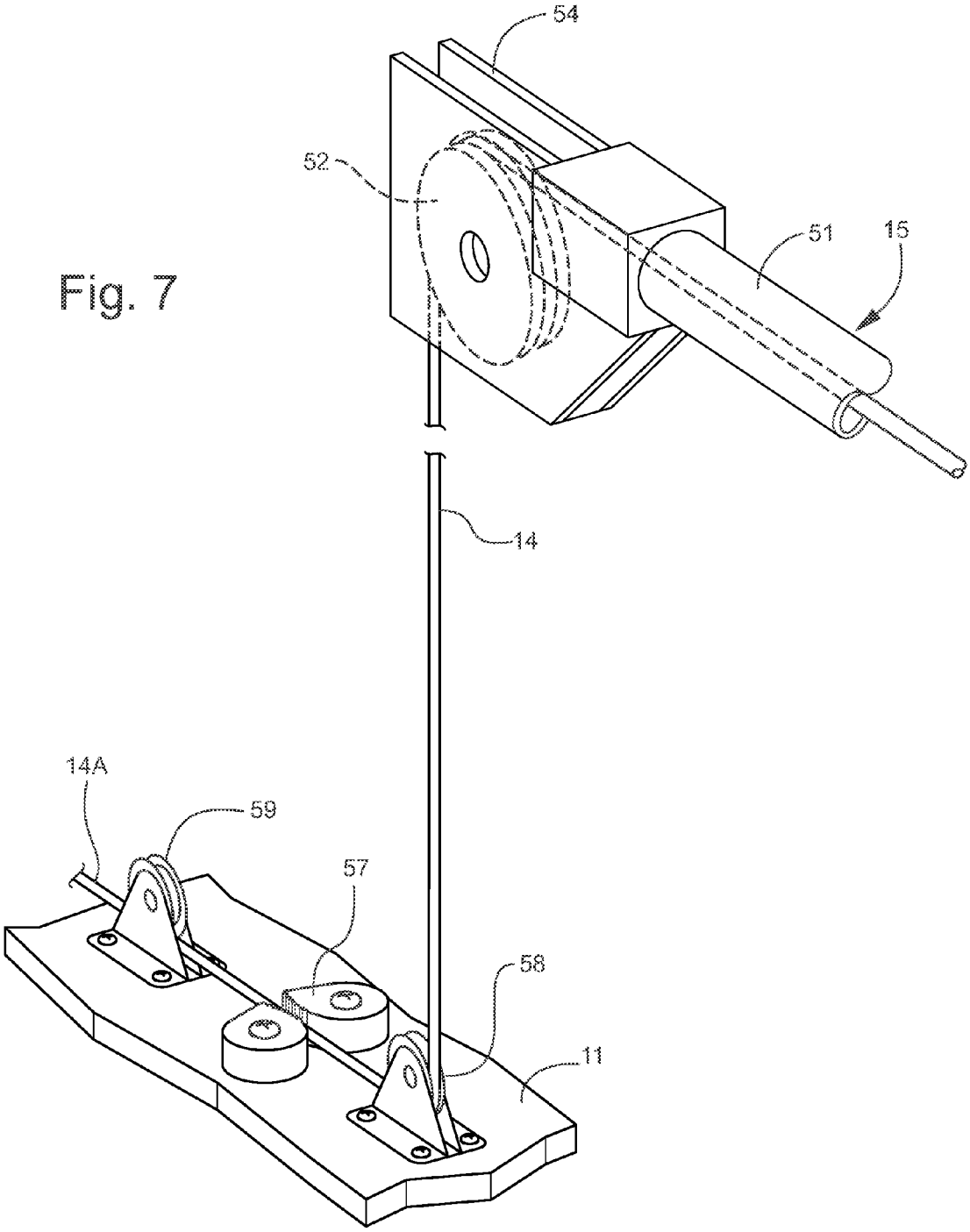
FIG. 7 is a fragmentary perspective view if the exercise bar and standing platform showing the cam cleat designed for securing the free end of the flexible cable.

The exemplary exercise bar 15 may be secured to the flexible cable 14, as illustrated in FIGS. 1, 6, 7, and 8. In this embodiment, the exercise bar 15 comprises an elongated rigid hollow member 51 with respective bar pulleys 52, 53 located at opposite open ends. The bar pulleys 52, 53 are attached via brackets 54, 55. A free end 14A of the flexible cable 14 is passed into the exercise bar 15 over bar pulley 52, and into and through hollow member 51, and outwardly over bar pulley 53 towards the standing platform 11. The cable 14 is temporarily fixed to the standing platform 11, as best shown in FIG. 7, by inserting the free end 14A through cam cleat 57 and spaced pulleys 58, 59 mounted on the platform 11. Pulling additional cable 14 through the cam cleat 57 lowers the maximum height of the exercise bar 15 in a zero resistance condition—i.e., the threshold point above which the force resistance assembly 12 becomes engaged. The threshold point may also comprise one extreme in the overall range of movement during a particular exercise; the other extreme being the highest point to which the exercise bar 15 is lifted away (or raised above) from the standing platform 11.

Figure 8:
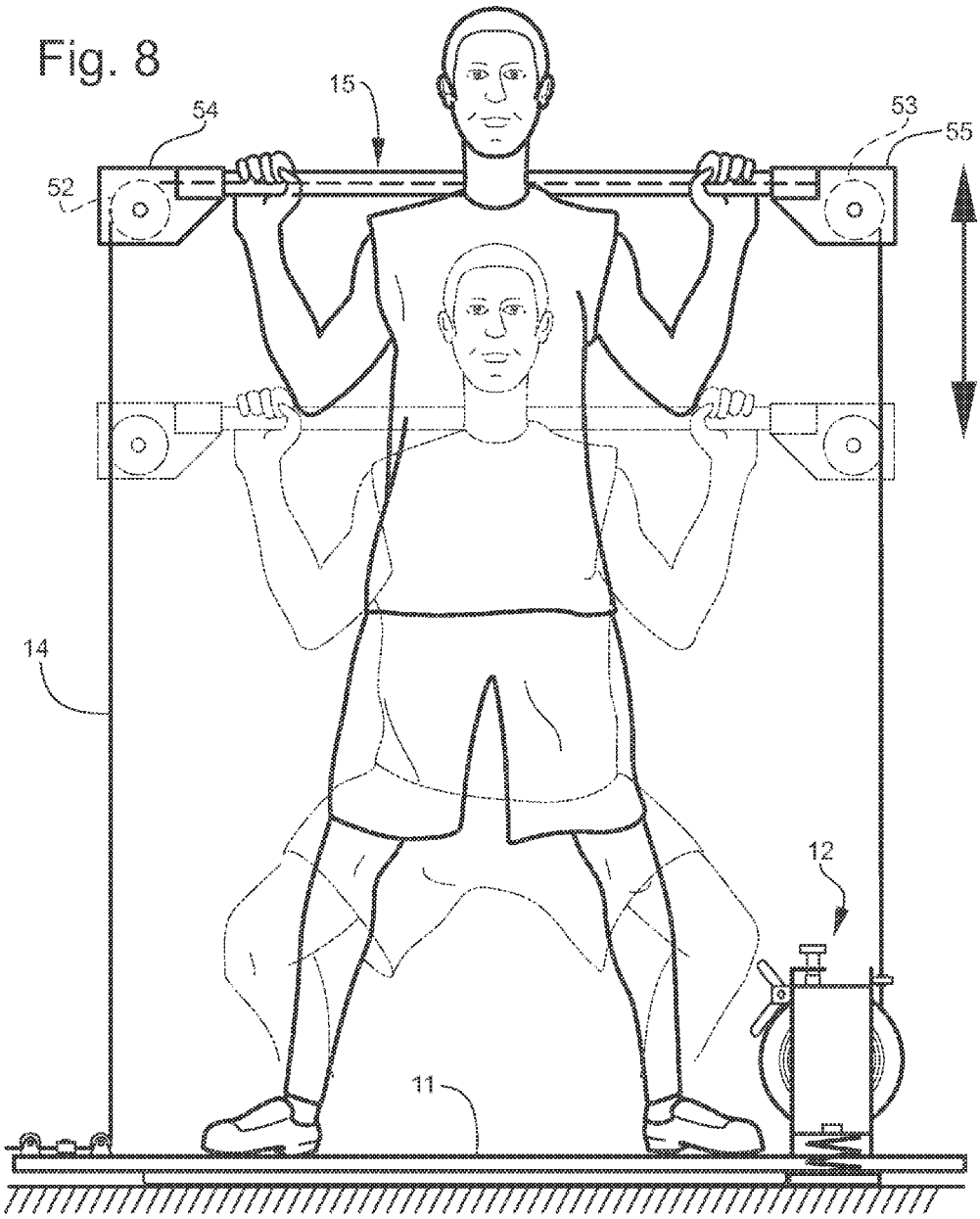
FIG. 8 is a view demonstrating use of the exercise device by a user performing a strength training exercise.

FIG. 8 demonstrates use of the exemplary exercise device 10 to perform full body squats. The user first establishes the zero-resistance height of the exercise bar 15, as previously described, by pulling the free end 14A of cable 14 through cam cleat 37. In a deep squatted position, the user places the exercise bar 15 behind the neck as shown. As the user begins to raise upwardly, the exercise bar 15 moves above the zero-resistance threshold point causing the force resistance assembly 12 to engage. The one-way cable spool 30 begins to rotate in the working direction to lengthen the cable 14 as the needle bearing 31 frictionally locks (or clamps) onto the hardened rotatable assembly shaft 22. Continued upward movement of the user and exercise bar 15 causes simultaneous rotation of the cable spool 30, assembly shaft 22, and disk rotor 25. The user force required to lengthen the cable 14 and thereby lift the exercise bar 15 is largely dictated by the hydraulic friction controller 28, as previously described, and the selected degree of engagement of friction pads 37, 38 against the disk rotor 22. Substantially smooth, uniform, constant resistance is applied throughout the entire range of movement of the exercise bar 15 as the user moves from the initial deep squatted position to a full standing position.

Figure 9:
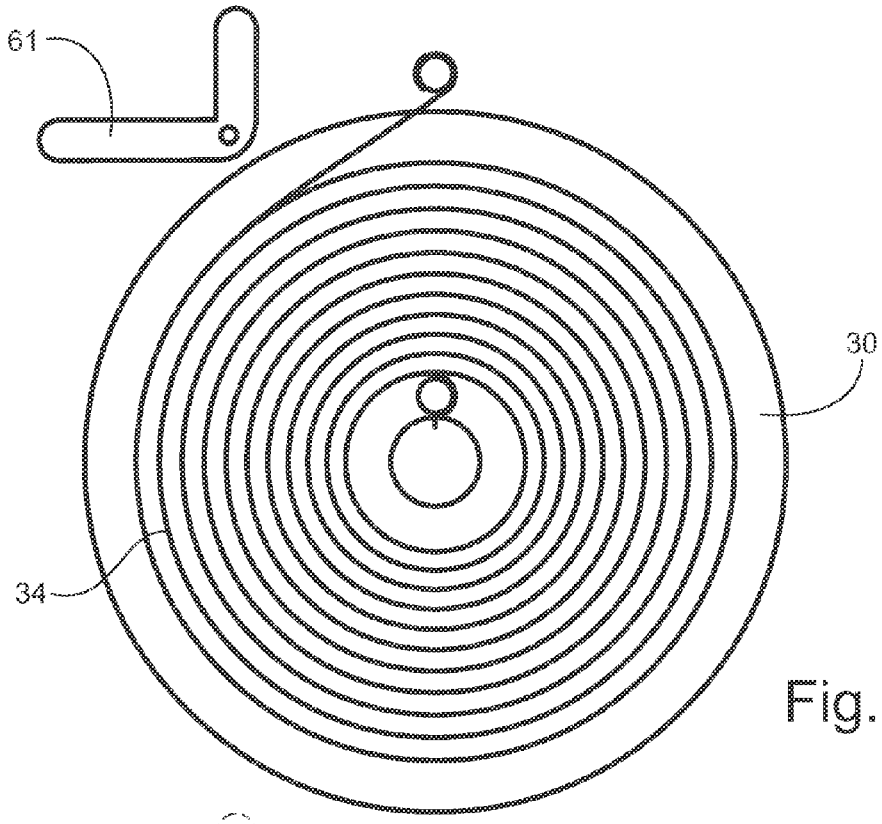
FIGS. 9 and 10 are views illustrating the pivoted foot stop in respective raised and lowered positions relative to the cable spool.
Figure 10:
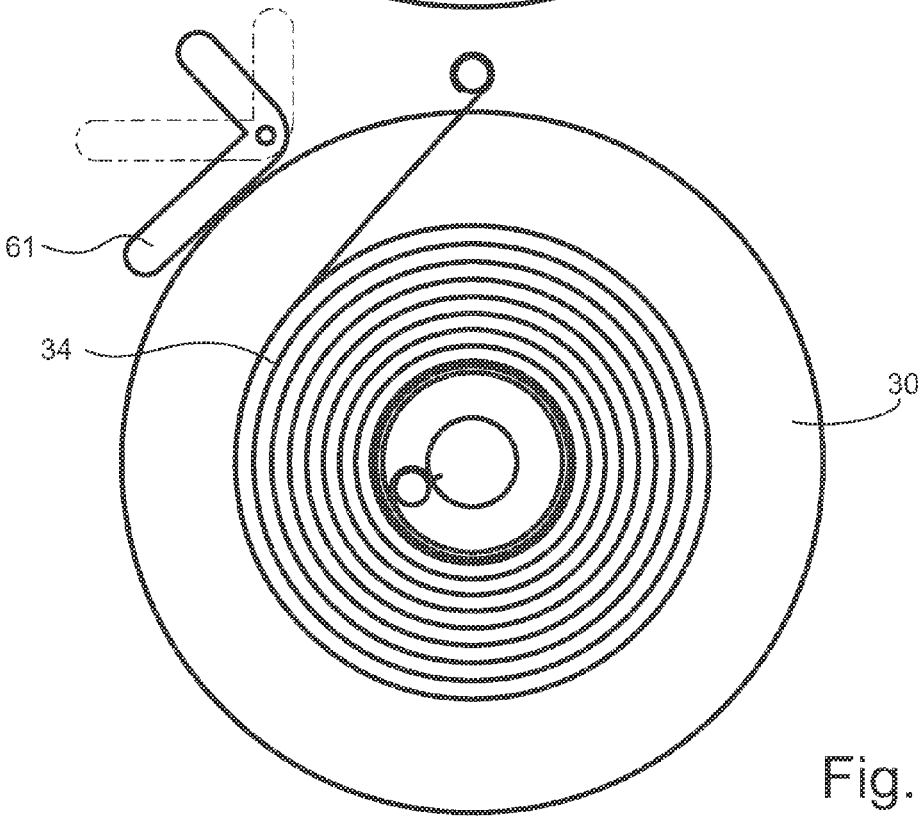

Moving from the full standing position back to the squatted position, torsion spring 34 causes the cable spool 30 to counter-rotate thereby unlocking the needle bearing 31 on the assembly shaft 22 and allowing the flexible cable 14 to retract and rewind within respective grooves 33 of cable spool 30 as the exercise bar 15 is lowered back towards the standing platform 11. The released cable spool 30 counter-rotates in the cable-wind-up direction independent of the assembly shaft 22 and disk rotor 25 (which both remain stationary). In the event a user desires to prevent or limit retraction (or shortening) of the cable 14 after completing a lift, a pivoted foot brake 61 best shown in FIGS. 9 and 10 may be employed to temporarily frictionally engage the cable spool 30 to stop its counter-rotation thereby setting the extended cable length such that the exercise bar 15 can be later relocated with essentially zero resistance back to its previous height above the standing platform 11. The spool-engaging surface of the foot brake 61 may comprise a rubber or other high friction material.

In addition to squats, the present exercise bar 15 and cleated cable attachment at the platform 11 may be used for other strength training exercises including, for example, military shoulder press, bench press, arm curls, arm extensions, bent-over rows, lat pulls, rowing exercises, and others. In alternative implementations, a shorter bar 15A shown in FIG. 1 may be attached to the free end 14A of the flexible cable 14 (via hook-and-eye or other cable connector), and used for exercises such as arm curls, arm extensions, and others. Other exercise bars and implements, such as angled bars, triangles, ropes, one-hand handles, and the like may also be used with the present device. The present exemplary exercise device 10 may provide resistance forces from 5 to 500 pounds, and could easily be adapted to provide more or less depending on the specific requirement. Additionally, the exemplary exercise device 10 may be used in combination with other strength training machines and implements, such as elastic bands, free weights, and others.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A cable exercise device, comprising:

a force resistance assembly comprising a mounting frame, a rotatable assembly shaft carried by said mounting frame, a disk rotor fixedly attached to said assembly shaft, an adjustable resistance controller adapted operatively engaging said disk rotor, and a one-way cable spool; said one-way cable spool being locked to said assembly shaft upon rotation of said cable spool in a working force-resistance direction, and freely movable relative to said assembly shaft upon rotation of cable spool in an opposite cable-wind-up direction;

an elongated flexible cable attached to said force resistance assembly, and adapted for winding onto and unwinding from said cable spool;

a standing platform located adjacent to said force resistance assembly; and a movable exercise implement attached to said flexible cable, and adapted for being employed by a user performing an exercise, said exercise implement comprising an elongated hollow bar having a cable-entry end and an opposing cable-exit end, and first and second bar pulleys located at respective cable-entry and cable-exit ends, and wherein said flexible cable extends through said bar and outwardly from its cable-exit end towards said standing platform.

2. The cable exercise device according to claim 1, and comprising a cable rewind spring operatively attached to said one-way cable spool, and adapted for normally urging rotation of said cable spool in the cable-wind-up direction.

3. The cable exercise device according to claim 1, wherein said one-way cable spool comprises a one-way needle bearing adapted for operatively engaging said assembly shaft upon rotation of said cable spool in the working force-resistance direction.

4. The cable exercise device according to claim 1, wherein said one-way cable spool comprises a plurality of circumferential grooves adapted for controlling overlap of said cable when winding on said spool.

5. The cable exercise device according to claim 1, and comprising first and second end bearings located at respective opposite ends of said assembly shaft.

6. The cable exercise device according to claim 1, wherein said resistance controller comprises a hand-turnable adjustment knob.

7. The cable exercise device according to claim 6, wherein said resistance controller further comprises first and second cooperating friction pads adapted for operatively engaging respective opposite surfaces of said disk rotor.

8. The cable exercise device according to claim 1, and comprising a pivoted foot stop adapted for operatively engaging said cable spool to limit rotation of said cable spool in the cable-wind-up direction.

9. The cable exercise device according to claim 1, and comprising means for releasably attaching the free end of said flexible cable to said standing platform.

10. The cable exercise device according to claim 9, wherein said means for releasably attaching said flexible cable comprises a cam cleat fixed to said standing platform.

11. The cable exercise device according to claim 1, and comprising an electronic scale adapted for measuring a force exerted by the user when performing the exercise.

12. The cable exercise device according to claim 11, and comprising a display monitor connected to said scale for displaying the measured force exerted by the user.

13. A cable exercise device, comprising:

a force resistance assembly comprising a rotatable assembly shaft and a one-way cable spool carried by said assembly shaft; and means for locking said one-way cable spool to said assembly shaft upon rotation of said cable spool in a working force-resistance direction, and for enabling free movement of cable spool relative to said assembly shaft upon rotation of cable spool in an opposite cable-wind-up direction;

an elongated flexible cable attached to said force resistance assembly, and adapted for winding onto and unwinding from said cable spool; and a standing platform located adjacent to said force resistance assembly; and a movable exercise implement attached to said flexible cable, and adapted for being employed by a user performing an exercise, said exercise implement comprising an elongated hollow bar having a cable-entry end and an opposing cable-exit end, and first and second bar pulleys located at respective cable-entry and cable-exit ends, and wherein said flexible cable extends through said bar and outwardly from its cable-exit end towards said standing platform.

14. The cable exercise device according to claim 13, wherein said force resistance assembly further comprises a disk rotor fixedly attached to said assembly shaft, and an adjustable friction controller adapted for frictionally engaging said disk rotor.

15. The cable exercise device according to claim 14, wherein said friction controller comprises a hand-turnable adjustment knob.

16. The cable exercise device according to claim 15, wherein said friction controller further comprises first and second cooperating friction pads adapted for operatively engaging respective opposite surfaces of said disk rotor.

17. The cable exercise device according to claim 13, and comprising a cable rewind spring operatively attached to said one-way cable spool, and adapted for normally urging rotation of said cable spool in the cable-wind-up direction.

* * * * *